United States Patent [19]

Back et al.

[11] Patent Number: 4,714,572

[45] Date of Patent: Dec. 22, 1987

[54] METHOD FOR THE MANUFACTURE OF COMPOSITE EXPLOSIVES

[75] Inventors: Sigurd Back; Jan-Olof Nyqvist, both of Karlskoga, Sweden

[73] Assignee: Nobel Kemi AB, Karlskoga, Sweden

[21] Appl. No.: 911,699

[22] Filed: Sep. 26, 1986

[30] Foreign Application Priority Data

Sep. 27, 1985 [SE] Sweden ..... 8504469

[51] Int. Cl.[4] ..... C06B 21/00

[52] U.S. Cl. ..... 264/3.4; 149/92; 149/105; 149/109.6; 264/3.1

[58] Field of Search ..... 149/105, 92, 109.6; 264/3.1, 3.4

[56] References Cited

U.S. PATENT DOCUMENTS

| | | | |
|---|---|---|---|
| 2,852,360 | 9/1958 | Gustav | 52/20 |
| 3,438,823 | 4/1969 | Ludolphy | 149/53 |
| 4,090,894 | 5/1978 | Reed et al. | 149/19.91 |
| 4,092,187 | 5/1978 | Hildebrant et al. | 149/11 |
| 4,336,209 | 6/1982 | Gylden et al. | 264/3.1 |
| 4,357,185 | 11/1982 | Ringbloom | 149/6 |
| 4,369,688 | 1/1983 | Yunan | 86/1 R |
| 4,376,083 | 3/1983 | Ulsteen | 264/3.5 |
| 4,380,186 | 4/1983 | Buhrer | 264/3.1 |
| 4,439,132 | 3/1984 | Morrison | 425/548 |
| 4,450,124 | 5/1984 | Christmann et al. | 264/3.1 |
| 4,488,916 | 12/1984 | Wanninger et al. | 149/105 |

*Primary Examiner*—Stephen J. Lechert, Jr.
*Attorney, Agent, or Firm*—Pollock, Vande Sande & Priddy

[57] ABSTRACT

The disclosure relates to a method for producing composite explosives of the type hexotonal and octonal by the intermediary of a two-stage wet granulation process comprising a first granulation stage for producing primary granules of a certain amount of TNT (the primary TNT) suspended in water, together with other desired components in the explosive, with the exception of the aluminum powder, which, in its turn, is mixed into the remaining amount of secondary TNT in order thereafter, in a secondary granulation stage, to be added to the mixing water with the primary granules suspended therein, for a successive build-up of their surface layer.

19 Claims, No Drawings

METHOD FOR THE MANUFACTURE OF COMPOSITE EXPLOSIVES

TECHNICAL FIELD

The present invention relates to a method for producing granulated hexotonal or alternatively octonal. Hexotonal and octonal are high-energy explosives based on Trinitrotoluene (TNT), hexogen or alternatively octogen and powdered aluminum. Moreover, minor amounts of phlegmatization—or as is also called in this Art desensitization—agents such as wax, lecithin and possibly also cellulose nitrate are further included.

BACKGROUND ART

Traditionally, hexotonal is produced by an addition of TNT, powdered aluminum and wax to a hexotol melt (hexogen+TNT). The thus obtained hexotonal mixture is thereafter cast to desired configuration. Thus, the direct manufacture of hexotonal has hitherto been effected in the explosives foundry in immediate association with its final shaping. This has entailed that part of the capacity of the explosives foundry has had to be devoted to other operations than the primary duty of the foundry, namely that of casting explosives into blasting charges or other explosive devices of the desired type. Furthermore, the handling of, above all the powdered aluminum is fraught with considerable risks, since this powder, on the one hand, reacts with water on being heated, generating hydrogen gas, and, on the other hand, the powdered aluminum shows a marked tendency to initiate dust explosions.

Octonal is traditionally manufactured in a corresponding manner and, as a result, that which generally applies in the manufacture of hexotonal also applies in principle to the manufacture of octonal.

Users within this Art have long voiced the wish to have access to a granulate hexotonal and octonal, respectively, which may be directly melted down and cast to the desired form. It would, namely, thereby become possible to transfer a perilously delicate manufacturing stage to the explosive makers and, at the same time, make available further resources in the user's own explosive foundry. For safety reasons, granules containing crystalline explosive substances such as hexogen and octogen are primarily manufactured by so-called wet granulation. This method has long been known in the Art, and a method particularly well-suited for granulation of TNT-containing composite explosives which also contain crystalline components is described in Swedish Pat. No. 158.663.

However, granulate hexotonal and octonal cannot be produced by wet granulation without further ado, since, as has previously been pointed out, hydrogen gas is, as a rule, generated on heating of powdered aluminum in water. It speaks for itself that an uncontrollable hydrogen gas generation in conjunction with the handling of a substance which is explosive, per se, cannot, for reasons of safety, be accepted. While, for example, an aluminum sheet surface in its pure form is protected by a natural oxide layer of $Al_2O_3$, this layer is hydroscopic and dissolves spontaneously in both acidic and basic solutions. Furthermore, powdered aluminum has a large specific surface area with many sharp corners, for which reason it reacts with hot water under violent hydrogen gas generation. Apart from wet granulation, a protected aluminum powder may also give rise to a certain hydrogen gas generation if a finished, aluminous explosive is stored in a damp and warm environment.

With a view to obviating the problems inherent in hydrogen gas generation in association with water, attempts have been made in this Art to inactivate the powdered aluminum by treating it with isostearic acid and/or stearic acid. However, this treatment method entails that the powdered aluminum shows a strong tendency to flocculate with the wax which is generally employed as phlegmatization agent in wet granulation of TNT with pararefractory crystalline or granulate substances such as hexogen or octogen, respectively. In its turn, this flocculation tendency impedes the production of homogeneously cast hexotonal and octonal, respectively, from powdered aluminum treated in this manner. This problem is aggravated by the fact that hexotonal and octonal are in themselves more sensitive to mechanical stresses than hexotol and octol and, consequently, generally contain more phlegmatization wax.

It has now, however, become possible, in accordance with the present invention, to produce granulated hexotonal and octonal, respectively, by wet granulation without the risk of an uncontrollable hydrogen gas generation on granulation or storage of the finished product and without, at the same time, imparting to the powdered aluminum such a propensity for flocculation that the finished product becomes inhomogeneous. The granulated hexotonal and octonal, respectively, produced according to the present invention may either be employed directly as low density charges or, after melting, be cast to high density charges.

The previously-mentioned Swedish Pat. No. 158.663 discloses a method of wet granulation of TNT-containing composite explosives, such as hexotol and octol, according to which an aqueous suspension is produced in a first stage (the primary stage) of all of the components included in the finished explosive apart from the TNT, there being then added, at a temperature which exceeds the melting point of the TNT, an amount of the TNT (=primary TNT) which has been empirically established as giving a homogeneous and non-tacky granulate together with the other components, when the mixture is cooled to below the melting point of the TNT. The thus obtained primary granules are subsequently placed in their mother liquor or in another suspension agent at a temperature below the melting point of the TNT, together with the molten remaining amount of TNT (=the secondary TNT). The secondary TNT then forms a coating on the primary granules. If the added amount of primary TNT is insufficient, inhomogeneous granules will readily be formed, and if this amount is excessive, there is the risk that the TNT be deposited, on cooling, in the form of a solid cake instead of forming granules with the other components.

Another aspect of the state of the Art is described in the 1976 NTIS report AD-A074705, by J. F. Drolet and R. R. Lavertn, relating to "Development of a Method to produce high Energy Blasting Prills". This report describes a method for producing pellets of TNT-aluminum-containing explosives which may also contain hexogen or octogen. The method is based on the concept that droplets of a melt containing the contemplated components are allowed to harden while falling through a water-filled cooling tower. In order to avoid a reaction between the powdered aluminum and the water, the former is deactivated by a minor addition of ammonium lignosulphonate.

A further aspect of the state of the Art consists of Norwegian Pat. No. 144666 (EPO Application No. 0035 376) which describes a method for the preparation of hexotonal and octonal, respectively, by wet granulation in water of hexogen (or octogen, respectively), wax and powdered aluminum treated so as to withstand water, to a first component A which is mixed and melted together with a second component B, consisting of TNT and possibly cellulose dinitrate and lecithin. The method as such is somewhat circumstantial and, for safety reasons, can only be put into effect employing powdered aluminum which is treated so as to withstand water.

SUMMARY OF THE INVENTION

However, we have found a simpler and safer method of manufacturing hexotonal and octonal with untreated powdered aluminum as an addition. The method according to the present invention may most closely be regarded as constituting a modified variation of the two-step process as disclosed in Swedish Pat. No. 158.663, discussed by way of introduction of our account of the state of the Art. According to the present invention, primary granules are first produced by a conventional wet granulation process in water, of an empirically tested amount of TNT (the primary TNT) and all other components with the exception of the powdered aluminum which, in its turn, is admixed to the melted remaining amount of TNT (the secondary TNT) which subsequently, in the molten state, is added to the wet granulation vessel with its primary particles already suspended in the mixing water, the powdered aluminum-admixed secondary TNT being successively deposited on the surface of the primary particles according as the temperature of the secondary TNT and powdered aluminum mixture is cooled to below the melting point of the TNT. The hexogen or the octogen, respectively, is added to the primary granulate as wax-phlegmatized standard product or are phlegmatized with wax direct in the mixing water before the primary TNT is added. The amount of primary TNT and suitable temperatures for the different process stages are established by experiment. However, as a rule, a suitable primary TNT amount should probably correspond to approximately 20% of the entire amount of TNT. We have also found that we obtain a more uniform distribution of the phlegmatization wax over the hexogen and octogen crystals, respectively, if these are first coated with a thin layer of oxazolin wax on which a suitable phlegmatization wax is deposited, for example one of the qualities well-known in this context, Wax composition 1 or Wax Composition D2. This improved method of phlegmatization of hexogen and octogen make for a superior starting material for the method according to the present invention.

We have also found that the presence of oxazolin wax in the hexotonal and octonal, respectively, would seem to counteract the flocculation tendencies which are nevertheless inherent even in untreated powdered aluminum and which would otherwise manifest themselves in remelting of the explosive in conjunction with the casting of finished explosive charges.

A suitable amount of oxazolin wax has proved to be approximately 0.015% calculated on the amount of hexogen in a hexotonal. The oxazolin wax is suitably added to the aqueous suspension of hexogen and octogen crystals, respectively, dissolved in a solvent, for example, chlorothene, which is driven off (at a temperature of 80°–85° C. when the solvent is chlorothene), whereafter the phlegmatization wax is added and the temperature of the mixing water is raised so that the wax melts and may be distributed over the granules. For Wax Composition 1, the temperature range is at eg. 90°–95° C. When all of the wax has melted, the temperature can be reduced to 80°–82° C. and the primary TNT be added. All operations are effected under agitation so as to obtain the correct distribution. If the primary TNT is added as, for example, a 110° C. melt, it should be possible to effect the primary granulation in a mixing water which is at a lower temperature than the above-proposed 80°–82° C. As soon as the primary granules have been finally formed, a minor amount of a surfactant—discussed in greater detail below—is suitably added, the purpose of the surfactant being to further protect the powdered aluminum which is then added intermixed in the approximately 110° C. melt of the secondary TNT. When the secondary TNT is added, the temperature of the mixing water should be approximately 72.5°–73° C. Once the final granulation has been effected, the thus obtained granules can be filtered-off from the mixing water and dried.

Hence, the above-outlined method according to the present invention makes it possible to employ completely untreated powdered aluminum and thereby mimimizes the risk that the powdered aluminum, at a later stage, for example in conjunction with remelting, flocculate with the wax. By mixing the pure, untreated powdered aluminum in the secondary TNT, the powder will, furthermore receive a protective coating of secondary TNT which repels the water from the powder. Moreover, in the method according to the present invention, the stay-time of the powdered aluminum in the water is reduced by approximately 75% as compared with the circumstance if the powdered aluminum had been added, in the primary stage, together with the other components such as hexogen, octogen, wax, etc.

As was mentioned above, a modification of the method according to the present invention entails an addition of a minor amount (approximately 0.02% calculated on the amount of aluminum) of a very special surfactant to the suspension agent (the mixing water) before the molten secondary TNT with its intermixed powdered aluminum is added. Surfactants most appropriately applicable to the purpose contemplated herein are most immediately represented by two commercial products entitled Berol TVM 724 and 594. These Berols consist of long-chained surface-active molecules with phosphate groups at one end position which possess good affinity to the aluminum surface and effectively inhibit hydrogen gas generation on contact with water. An addition of any of these Berols would, hence, provide an extra safeguard against the previously-discussed hydrogen gas generation.

The present invention has been defined in the appended claims, and will now be described in greater detail by way of nonrestrictive exemplification in conjunction with a number of representative Examples.

EXAMPLE 1

A volume of 25 liters of water was added to a reaction vessel equipped with a mechanical agitator and provided with heating and cooling means. During continuous agitation (200–250 rpm), and while the temperature of the water was raised to 90° C., batches of 4 kg of hexogen and 0.6 g of oxazolin wax dissolved in chlorothene were added. When all chlorothene had been driven off as a consequence of the temperature elevation and the oxazoline wax had been deposited on the hexogen, 0.5 kg of wax (of a wax quality widely used in hexotonal contexts, designated Wax Composition 1) was added. Once phlegmatization of the hexogen had been completed, the temperature of the mixture was reduced to 80° C., whereafter 0.8 kg of primary TNT was added. After the primary granulation, the temperature of the mixture was reduced to approximately 70°–75° C., and thereafter 3.2 kg of molten 110° C. secondary TNT intermixed with 1.5 kg of powdered aluminum was added.

Hexogen and TNT were of current standard market quality and the powdered aluminum was of a type which satisfies the requirements as laid down in Standard Regulations Mil-A-512A Type III, grade F, Class 6.

When the final granulate form had been attained, the batch was cooled to approximately 50° C. and Nutsch filtered.

The thus obtained product displayed granules of a size of 1–2 mm. These firmly retained the powdered aluminum and no loose powdered aluminum could be demonstrated.

In order to be able to ascertain any possible hydrogen gas generation during the granulation process proper, samples were taken using both Draeger tubes and evacuated gas pipettes, at the water surface immediately after completed granulation. Neither the Draeger tubes nor CG examination of the contents of gas pipettes gave any indication of hydrogen gas.

Hydrogen gas generation from finished granules submersed in 70° C. water was checked in a special bomb and even under these conditions, the generation of hydrogen gas proved to be wholly insignificant.

Moreover, casting samples were taken with the finished hexotonal, on the one hand to check that the powdered aluminium did not flocculate in the cast product, and, on the other hand, with respect to other casting faults.

A visual examination of a cross-section through the cast hexotonal showed that the aluminum powder had not flocculated. Sample casting of a plurality of charges gave good casting quality.

EXAMPLE 2

The experiment was carried out in the same manner as the experiment disclosed in Example 1, but with the amounts indicated below and with the following exception. The "primary granulation" was carried out at considerably lower temperature (approx. 73° C.), which was made possible because the primary TNT was also added in the molten state, and moreover Berol TVM 724 was added to the mixing water immediately prior to the addition of the secondary TNT. Both Berol TVM 724 and Berol 594 are temperature-sensitive and they should, therefore, be first added immediately prior to the secondary TNT.

COMPOSITION 40.9 kg of TNT, of which 20% was batched in the primary granulation stage and the remaining 80% in the secondary stage.

30.5 kg of hexogen with a particle size of
>0.5 mm max. 1%
<0.5 mm max. 1%

23.8 kg of powdered aluminum 4.8 kg of D2A wax 5 g of oxazoline wax 4 g of Berol TVM 724

The thus obtained product was tested in the same manner as that disclosed under Example 1 and with the same favorable results.

EXAMPLE 3

Manufacture of Octonal

The manufacture of Octonal is effected in analogy with that disclosed in Example 1.

A volume of 25 liters of water was added to a reaction vessel equipped with a mechanical agitator and provided with heating and cooling means. During continuous agitation (200–250 rpm), and while the temperature of the water was raised to 90° C., batches of 4.5 kg of octogen and 0.6 g of oxazolin wax dissolved in chlorothene were added. When all chlorothene had been driven off as a consequence of the temperature elevations and the oxazolin wax had been deposited on the octogen, 0.3 kg of wax (of a wax quality according to Mil-W-20553) was added. Once phlegmatization of the octogen had been completed, the temperature of the mixture was reduced to 84° C., whereafter 0.6 kg of primary TNT was added. After the primary granulation, the temperature of the mixture was reduced further to approximately 70°–75° C., and thereafter 2.4 kg of molten 110° C. secondary TNT intermixed with 2.2 kg of powdered aluminum was added.

Octogen and TNT were of current standard market quality and the powdered aluminum was of a type which satisfies the requirements as laid down in Standard Regulations Mil-A-512A.

After the addition of the secondary TNT and aluminum powder, the batch was cooled to approximately 50° C. and Nutsch filtered.

The thus obtained product displayed granules in the range of 1–2 mm of uniform size. No free aluminum powder could be demonstrated.

What we claim and desire to secure by Letters Patent is:

1. A two-stage wet granulation method for producing a composite explosive whose major components are hexogen or octogen, and trinitrotoluene, aluminum powder, and phlegmatization wax wherein said aluminum powder is in the form of pure, untreated powder which comprises suspending in water a first wet granulation stage, said hexogen or octogen, and said phlegmatization wax;

adding thereto a primary portion of said trinitrotoluene in the molten state or under such temperature conditions that said trinitrotoluene melts, the amount of said primary portion of said trinitrotoluene is such as to give homogeneous and uniformly-sized granules with the ingredients suspended in water;

cooling said primary portion of said trinitrotoluene to thereby form primary granules with the other components suspended in water;

mixing said aluminum powder in the form of pure, untreated powder into the remaining secondary portion of said trinitrotoluene in the molten state to form a homogeneous mixture; and adding said homogeneous mixture in a second wet granulation stage to the granules suspended in the water to thereby form secondary granules.

2. The method as claimed in claim 1, characterized in that the amount of oxazolin wax lies in the order of magnitude of from 0.010 to 0.020%, calculated on the crystalline explosive included in the composite explosive.

3. The method as claimed in claim 1 characterized in that the amount of oxazoline wax is added to the mixing water dissolved in chlorothene which is driven off from the mixing water before the phlegmatization wax is added.

4. The method as claimed in claim 1, characterized in that there is added a minor amount of a long-chain surfactant containing end-bonded phosphate groups, to the mixing water immediately before the molten secondary TNT with the intermixed aluminum powder is added.

5. The method as claimed in claim 4, characterized in that said surfactant is added in an amount corresponding to from 0.010 to 0.020%, calculated on the amount of aluminum powder.

6. The method as claimed in claim 1, characterized in that the different stages of the granulation process are carried out under continuous and controlled agitation and temperature regulation.

7. The method as claimed in claim 2, characterized in that the amount of oxazoline was is added to the mixing water dissolved in chlorothene which is driven off from the mixing water before the phlegmatization wax is added.

8. The method as claimed in claim 1, characterized in that there is added a minor amount of a long-chain surfactant containing end-bonded phosphate groups, to the mixing water immediately before the molten secondary TNT with the intermixed aluminum powder is added.

9. The method as claimed in claim 2, characterized in that there is added a minor amount of a long-chain surfactant containing end-bonded phosphate groups, to the mixing water immediately before the molten secondary TNT with the intermixed aluminum powder is added.

10. The method as claimed in claim 3, characterized in that there is added a minor amount of a long-chain surfactant containing end-bonded phosphate groups, to the mixing water immediately before the molten secondary TNT with the intermixed aluminum powder is added.

11. The method as claimed in claim 1, characterized in that said surfactant consists of one of the commercial products Berol TVM 724 or Berol 594; and that this is added in an amount corresponding to from 0.010 to 0.020%, preferably about 0.015%, calculated on the amount of aluminum powder.

12. The method as claimed in claim 8, characterized in that said surfactant is added in an amount corresponding to from 0.010 to 0.020%, calculated on the amount of aluminum powder.

13. The method as claimed in claim 9, characterized in that said surfactant is added in an amount corresponding to from 0.010 to 0.020%, calculated on the amount of aluminum powder.

14. The method as claimed in claim 10, characterized in that said surfactant is added in an amount corresponding to from 0.010 to 0.020%, calculated on the amount of aluminum powder.

15. The method as claimed in claim 1, characterized in that the different stages of the granulation process are carried out under continuous and controlled agitation and temperature regulation.

16. The method as claimed in claim 2, characterized in that the different stages of the granulation process are carried out under continuous and controlled agitation and temperature regulation.

17. The method as claimed in claim 3, characterized in that the different stages of the granulation process are carried out under continuous and controlled agitation and temperature regulation.

18. The method as claimed in claim 4, characterized in that the different stages of the granulation process are carried out under continuous and controlled agitation and temperature regulation.

19. The method as claimed in claim 5, characterized in that the different stages of the granulation process are carried out under continuous and controlled agitation and temperature regulation.

* * * * *